United States Patent [19]

Lapotaire

[11] Patent Number: 4,804,305

[45] Date of Patent: Feb. 14, 1989

[54] MOVABLE PLATFORM SYSTEM

[76] Inventor: Robert Lapotaire, 118 Fairway Dr., Covington, La. 70433

[21] Appl. No.: 101,290

[22] Filed: Sep. 25, 1987

[51] Int. Cl.[4] ..... E04H 6/06

[52] U.S. Cl. ..... 414/233; 104/23.1; 104/48; 405/2

[58] Field of Search ..... 414/233; 104/23.1, 48; 114/259, 260; 405/2, 201; 446/153, 154; 198/721; 269/20

[56] References Cited

U.S. PATENT DOCUMENTS

| | | | |
|---|---|---|---|
| 1,486,275 | 3/1924 | Becker | 214/16.1 |
| 1,565,907 | 12/1925 | Comb | 214/214 |
| 1,887,667 | 11/1932 | Wheeler | 214/16.1 |
| 1,896,021 | 1/1933 | Taylor | 114/266 |
| 2,386,132 | 10/1945 | McLarty | 114/0.5 |
| 2,605,911 | 8/1952 | Medway | 214/16.1 |
| 3,021,544 | 2/1962 | Gillois | 114/266 |
| 3,372,817 | 3/1968 | Conklin | 214/16.1 |
| 3,563,400 | 2/1971 | Greaves | 214/16.1 |
| 3,675,378 | 7/1972 | Neumann | 214/214 |
| 3,691,974 | 9/1972 | Seiford | 114/114 |
| 3,774,784 | 11/1973 | Glass | 214/104 |
| 3,858,877 | 1/1975 | Lundstrom | 273/114 |
| 3,876,085 | 4/1975 | Bright | 214/16.1 |
| 4,109,804 | 8/1978 | Moyano | 214/104 |
| 4,217,070 | 8/1980 | Groger | 414/16.1 |
| 4,262,381 | 4/1981 | Blink | 114/266 |
| 4,286,538 | 9/1981 | Matsui | 114/266 |
| 4,321,882 | 3/1982 | Sluys | 114/266 |
| 4,487,151 | 12/1984 | Deiana | 114/266 |
| 4,602,587 | 7/1986 | Lyons | 114/264 |

*Primary Examiner*—Robert J. Spar
*Assistant Examiner*—Stuart J. Millman
*Attorney, Agent, or Firm*—Robert C. Tucker; William David Kiesel; Timothy J. Monahan

[57] ABSTRACT

A movable platform system is provided, comprising a basin, defined by a bottom and a sidewall, the basin containing a liquid; a plurality of support structures, extending upward from the bottom, the support structures being aligned in rows, the rows being perpendicular to each other; a plurality of platforms each having a top surface and an underside, the platforms being floatable in the liquid, each of the platforms having a plurality of guides attached to the underside, for guiding movement of the platforms in the basin, at least one of the guides being aligned perpendicular to another, wherein a plurality of the support structures extend into the guides; and a plurality of bearing devices, attached to the support structures so as to support the underside of the platforms within the guides and allow the platforms to move parallel to the bottom along some of the rows of the support structures.

19 Claims, 5 Drawing Sheets

MOVABLE PLATFORM SYSTEM

BACKGROUND OF THE INVENTION

1. Field of the Invention

This invention relates generally to movable platform systems and, more particularly, to those movable platform systems which are adaptable for vehicle parking applications.

2. Prior Art

As the value of property increases, especially in large metropolitan areas, the need for economical high density parking systems also increases. Maximum utilization of vehicle parking areas has long been a major concern in downtown and airport locations. Attempts have been made to provide various types of movable platforms for parking use. Most systems utilizing movable platforms employ some sort of drive mechanism to move a platform from one location to another in order to efficiently arrange vehicles (such as automobiles or airplanes) in positions so as to maximize usage of storage. Complicated chain and conveyor drives as well as complex roller assemblies have been tried to provide maximum movement flexibility and access to vehicles once they are stored.

One problem associated with the prior art is the capital cost necessary to construct a parking lot having complex mechanical equipment. A second problem involves the cost of maintaining such equipment. Safety is also a consideration. The exposed chain drives of some of the prior art pose a safety hazard to users of a parking surface. All of the aforementioned problems involve costs to be taken into account when evaluating the economic feasibility of a parking project. Despite the drawbacks of the prior art, a movable platform parking system is still beneficial to increase the efficiency of overcrowded parking areas.

Additionally, movable platform systems have uses other than for parking vehicles. One such use is in the area of stage construction, where performance stages vary in design according to the type of performance, choreography, etc. Again, movement of platforms in such situations demands flexibility and economy as well as safety.

SUMMARY OF THE INVENTION

Therefore, it is an object of this invention to provide a movable platform system which will accommodate the parking of vehicles on individual platforms and allow movement of the platforms within the system.

It is another object of this invention to provide a movable platform system which requires only human energy to move individual platforms within the system.

It is still another object of this invention to provide a movable platform system which utilizes the buoyant forces of a liquid such as water.

It is a further object of this invention to provide a movable platform system which reduces space requirements for access to parking spaces.

Accordingly, a movable platform system is provided, comprising a basin, defined by a bottom and a sidewall, the basin containing a liquid; a plurality of support structures, extending upward from the bottom, the support structures being aligned in rows, the rows being perpendicular to each other; a plurality of platforms each having a top surface and an underside, the platforms being floatable in the liquid, each of the platforms having a plurality of guides attached to the underside, for guiding movement of the platforms in the basin, at least one of the guides being aligned perpendicular to another, wherein a n plurality of the support structures extend into the guides; and a plurality of bearing devices, attached to the support structures so as to support the underside of the platforms within the guides and allow the platforms to move parallel to the bottom along some of the rows of the support structures.

Still other objects and advantages of the invention will become obvious to one skilled in the art after a review of the instant disclosure.

DETAILED DESCRIPTION OF PREFERRED EMBODIMENTS OF THE INVENTION

Figure 1:
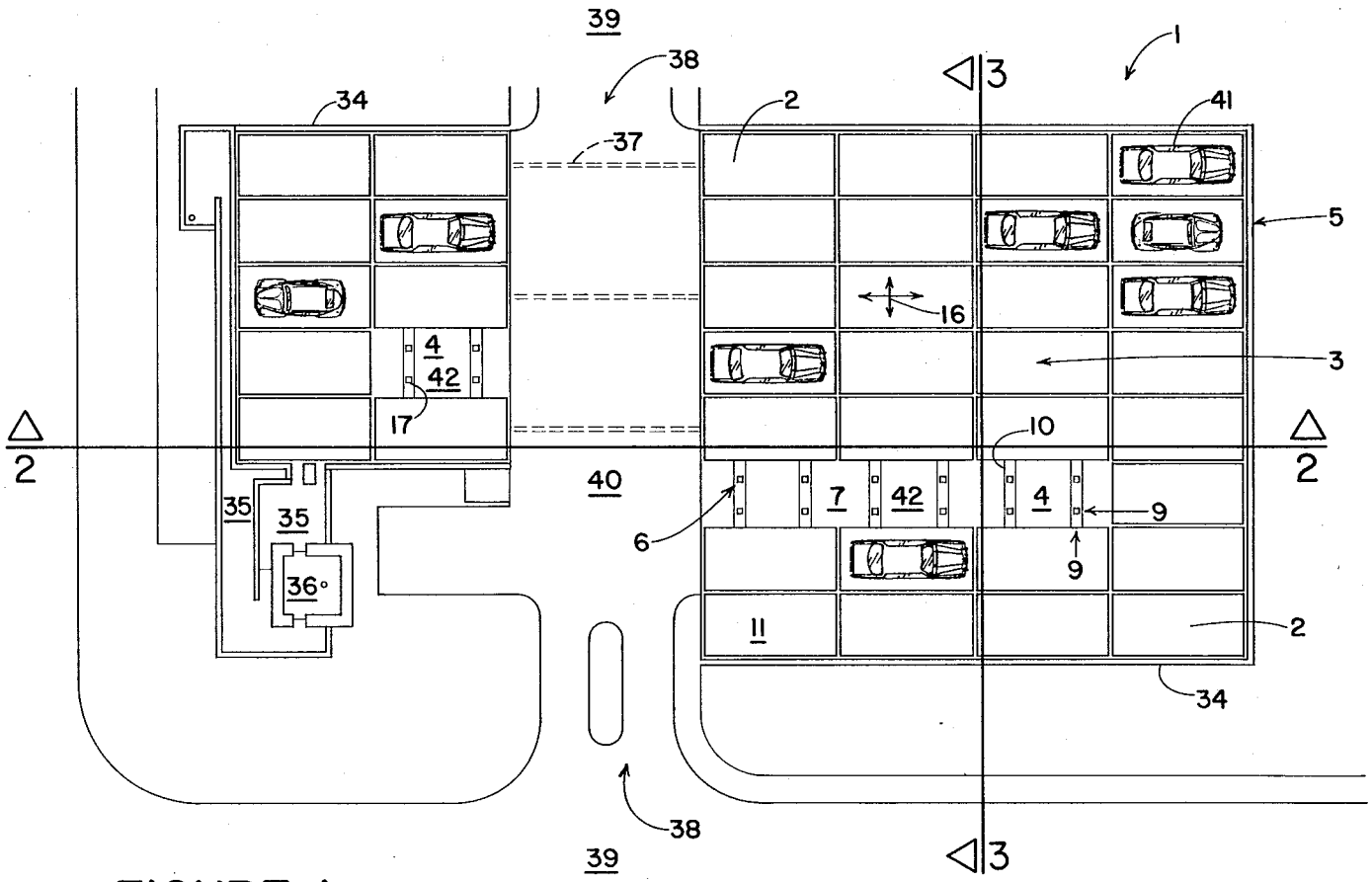
FIG. 1 is a plan view of a preferred embodiment of the invention in use as a vehicle parking system.

This invention provides a movable platform system 1 which is adaptable for any application wherein a plurality of platforms 2 are movable to alternate positions so as to form one or more surface areas 3. Platforms 1 floatable on a relatively shallow layer of liquid 4 (preferably water) which is contained in a basin 5. Such surface areas 3 may be used for a multiplicity of purposes. Primarily, the system 1 is useful as a vehicle parking lot, as shown in the Figures. Although the Figures show an application for automobile parking, the system 1 may be utilized for other vehicle parking applications, such as for aircraft. Also, varying combinations of surface areas 3 may be utilized for performance stages or other non-parking applications, either alone or in combination with parking lot use. Other applications include containerized storage facilities such as warehouses or docks, where various sized surface areas 3 may be linked together and moved as a unit, eliminating the need for moving individual containers.

Figure 4:
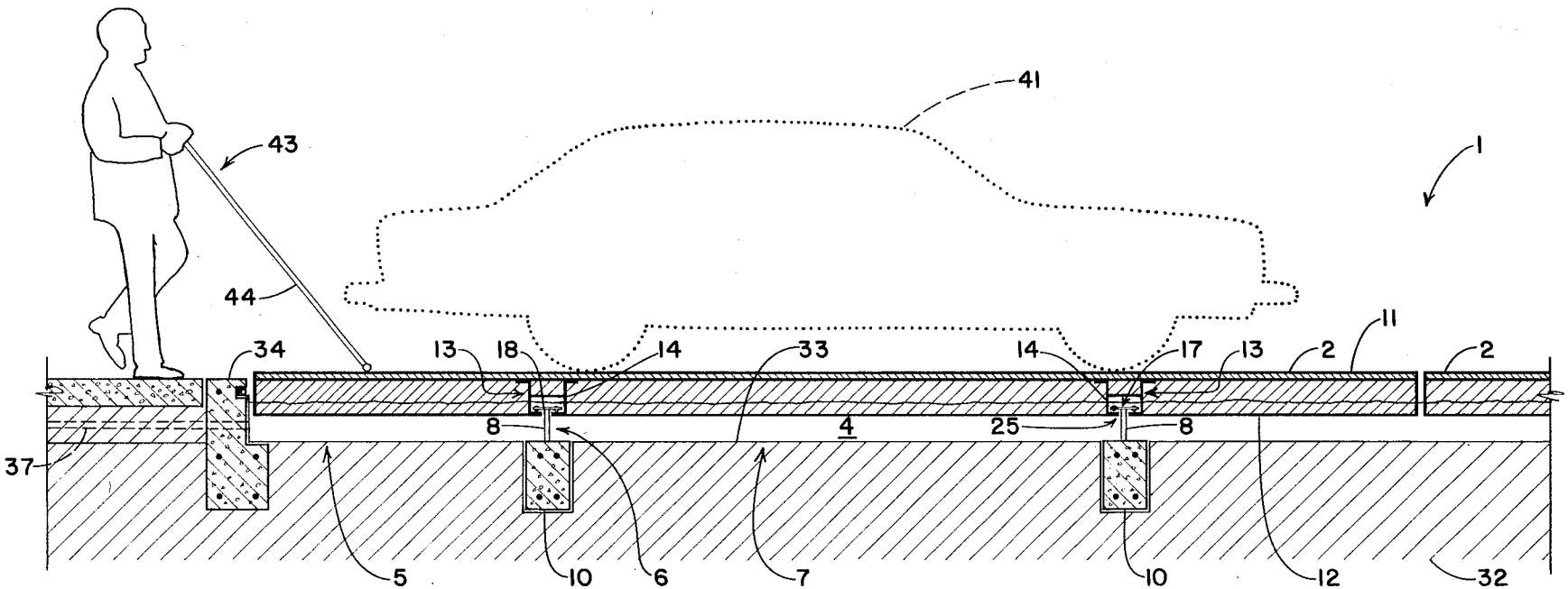
FIG. 4 is a sectional view of a typical movable platform utilized in the embodiment shown in FIG. 1.

As can be seen in FIG. 1, the system 1 preferably contains several platforms 2. The platforms 2 are supported at least in part by the buoyant force of the liquid 4. During operation it is also preferable that platforms 2 be sometimes supported by a plurality of support means 6, extending upward from bottom 7 of basin 5. Support means 6 provide additional stability to platforms 2 and aid in guiding movement of platforms 2. It is preferable that each support means 6 comprise a vertically extending strut 8, with struts 8 being arranged in rows 9, with rows 9 being perpendicular to each other. It is preferable that struts 8 be firmly fixed in place, utilizing means such as concrete beams 10, as shown in FIG. 4.

Figure 5:
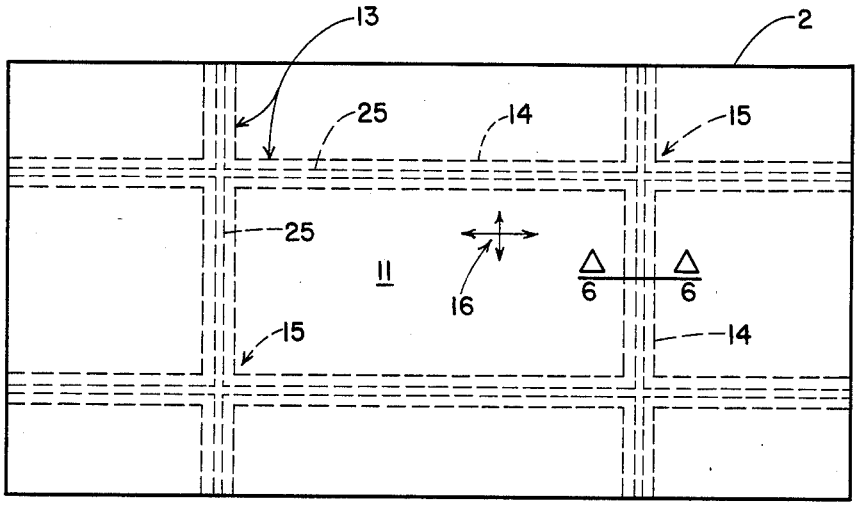
FIG. 5 is a plan view of a preferred embodiment of the movable platform of the invention.
Figure 6:
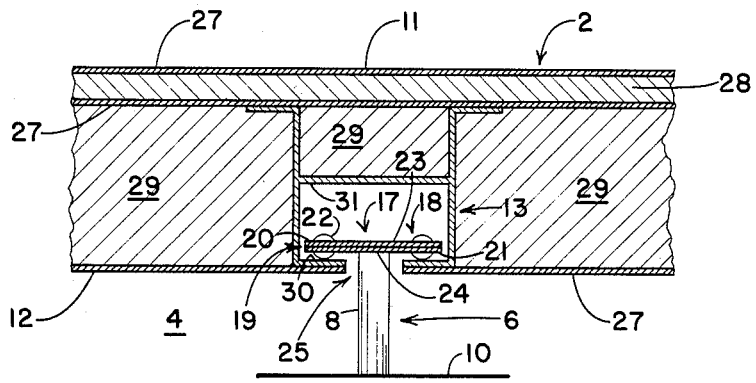
FIG. 6 is a sectional view of the movable platform of the invention taken along line 6—6 of FIG. 5.

Each platform 2 has a top surface 11, which is preferably a skid-resistant deck in parking embodiments, and an underside 12. Each platform 2 is further provided with a plurality of guide means 13, for guiding movement of the platform 2 in basin 5. Preferably, guide means 13 take the form of guide channels 14, positioned on the underside 12 of each platform 2. A detail of guide channel 14 construction is shown in FIG. 6. In parking applications, two guide channels 14 should run in one direction and two additional guide channels 14 should run perpendicular to the first two, as shown in FIG. 5, giving each platform 2 additional stability, plus the ability to move along perpendicular lines of travel, indicated by travel arrows 16. Thus, four guide channel intersections 15 will be formed on each platform 2.

Figure 8:
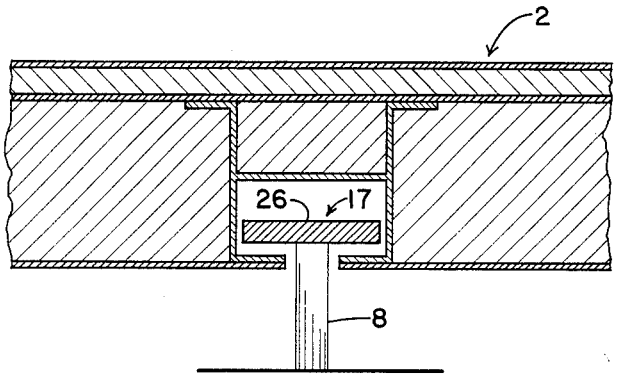
FIG. 8 is a sectional view of the movable platform of the invention taken along line 6—6 of FIG. 5 utilizing a low friction pad instead of a roller assembly.

Since struts 8 are stationary, bearing means 17 are provided for supporting the underside 12 of platforms 2 and allowing platforms 2 to move parallel to bottom 7 along some of the rows 9 of support means 6. Bearing means 17 may take any form known in the art. One form is principally shown in the Figures. Attached to each strut 8 is a roller assembly 18. Each assembly 18 comprises a roller containment structure 19, including upper plate 20 and lower plate 21, fixedly attached to strut 8. Plates 20 and 21 serve to rotatably contain a plurality of spherical rollers 22, such that rollers 22 extend from upper surface 23 and lower surface 24 of roller containment structure 19. Depending upon the materials used for construction of roller assembly 18, bearings (not shown) may be required to reduce friction between rollers 22 and roller containment structure 19. Four rollers 22 are preferred in order to evenly distribute loads and reduce friction. It is preferable that guide channels 14 and the entire bearing means 17 be constructed of or coated with high-lubricity materials, such as Teflon® or Delrin® in order to promote a low friction environment. FIG. 8 shows a detail of an alternate embodiment of bearing means 17, including a low friction pad 26 in place of roller assembly 18. Of course, low friction pad 26 should be constructed of materials such as those mentioned above in order to encourage ease of movement of platforms 2.

Figure 7:
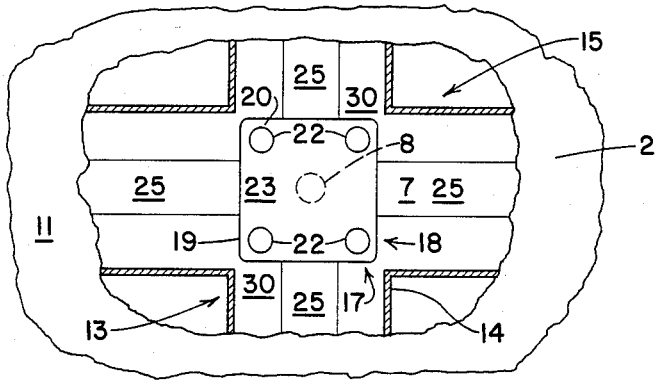
FIG. 7 is a cutaway plan view of an intersection of guide channels of the movable platform shown in FIG. 5.

Longitudinal slots 25 are provided in guide channels 14. Struts 8 extend through slots 25, placing bearing means 17 inside of guide channels 14. Slots 25 and guide channels 14 thus serve to guide perpendicular movement of platforms 2. Slots 25 intersect at guide channel intersections 15, allowing a perpendicular change of directional movement of platforms 2. A detail of an intersection 15 is shown in FIG. 7. Rollers 22 should be spaced so as to bear on guide channels 14 when roller assembly 18 is at an intersection 15.

Platform 2 and guide channel 14 construction may be as shown in FIGS. 5–7. It is of course preferable that platforms 2 be lightweight and structurally sound, so as to minimize movement when loaded. As shown in FIG. 6, platforms 2 should be encased with layers of hardened material 27 such as fiberglass (or other fiber reinforced plastic). The top surface 11 should have an abrasive finish to prevent slipping. Beneath top surface 11 should be a structural core 28 of sufficient strength and stiffness to bear the anticipated loads on the platform 2. It is preferable that core 28 be composed of a high-strength plastic, wood or other lightweight, high-strength material. Guide channel 14 also provides stiffness and support for platform 2 and should be constructed of high-strength material. Floatation foam 29, or any other suitable floatation material should occupy the remainder of the platform structure so as to provide maximum floatation when a platform 2 is loaded.

In the situation in which a platform 2 is unloaded, or is loaded only to a slight degree, roller assembly 18 will bear against the lower interior surface 30 of guide channel 14, as shown in FIG. 6. In such a case, the buoyant force exerted by liquid 4 will overcome the weight of the platform 2 and its load to such an extent that contact is maintained between roller assembly 18 and lower surface 30. For automobile parking applications, an unloaded platform 2 is preferably held down by roller assemblies 18 so as to resist an uplift force of two thousand pounds on platform 2. For example, up to 2000 pounds of load may be placed on platform 2 before further downward movement of platform 2 displaces additional liquid 4. In one automotive parking embodiment, additional downward displacement of approximately 3 inches occurs as the load is increased from 2000 to 4200 pounds. Marginal weight above 4200 pounds is carried by roller assemblies 18 and struts 8 as roller assemblies 18 bear against the upper interior surface 31 of guide channels 14. Of course, during the load range between 2000 and 4200 pounds, free floatation occurs, allowing virtually frictionless movement of platforms 2.

Figure 2:
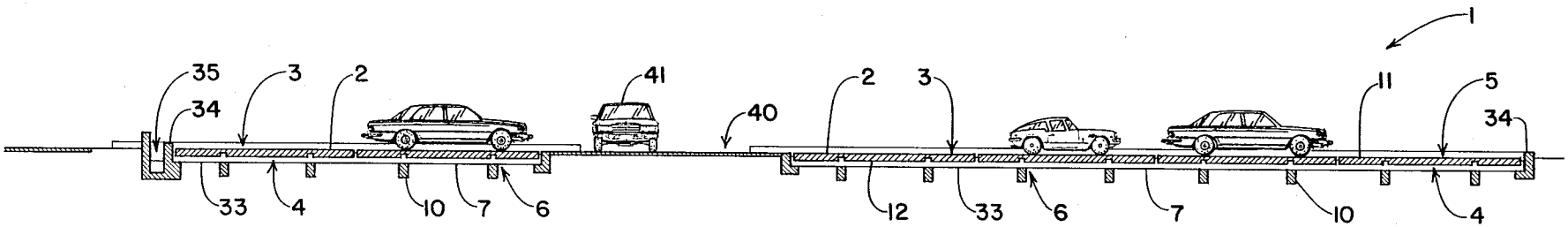
FIG. 2 is a sectional view of the invention taken along line 2—2 of FIG. 1.
Figure 3:
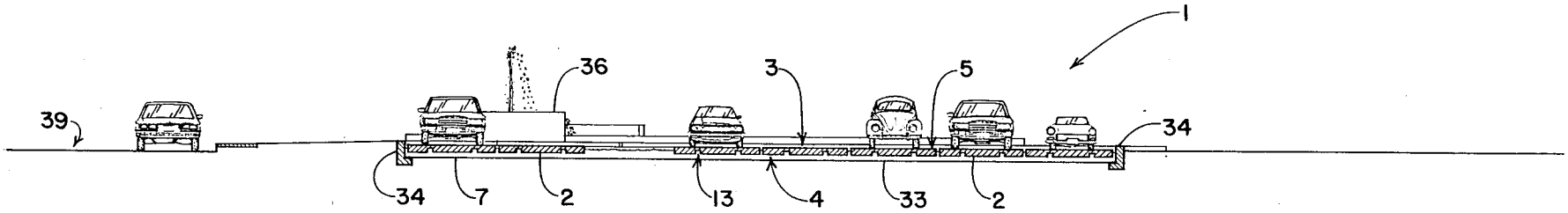
FIG. 3 is a sectional view of a typical movable platform utilized in the embodiment shown in FIG. 1.

As shown in FIGS. 2, 3 and 4, the bottom 7 of basin 5 preferably comprises a sub-base 32 topped by an impervious liner 33. A sidewall 34 encases the perimeter of basin 5. In permanent systems 1 sidewall 34 may be a poured in place concrete wall. Concrete beams 10 traverse bottom 7 and support struts 8. As stated above, struts 8 are aligned in perpendicular rows 9 aligned with the desired directions of platform travel 16.

The water or other liquid 4 in basin 5 will have a level which fluctuates according to various conditions. In a parking application, rainfall needs to be handled in some fashion. Overflow basin 35 provides a means for maintaining water at desired levels. Also, aesthetic considerations may suggest the addition of a fountain 36 or other device which serves the dual purpose of preventing water stagnation and providing an attractive addition to the system 1. Water in basins 5 having a close proximity to each other may be maintained at equal levels by utilizing leveler tubes 37 between basins 5.

FIG. 1 shows a typical system 1 in operation. Entry points 38 provide access to the system 1 from streets 39. Access drive 40 provides a staging area for loading platforms 2 with vehicles 41. The access drive 40 itself may comprise a group of platforms 2, allowing the access drive 40 to be relocated when necessary. Vehicles 41 may be driven onto a desired platform 2, parked and locked. It may be desirable to drive slowly over several platforms 2 to a desired platform 2. Open spaces 42 are provided in each basin 5 in order to allow platforms to be moved from place to place. Thus, movement of a vehicle or other load may be accomplished by simply shifting occupied platforms 2 aside into open spaces 42 and pushing the desired platform 2 to a desired location. A vehicle 41 on a particular platform 2 need not be unlocked or otherwise disturbed by a parking attendant. Movement of platforms 2 may be accomplished utilizing a means 43, for moving platforms 2 from one location to another, the means 43 being selectively engageable with one or more platforms 2. The means 43 may be as simple as a rod 44 which is used to manually push platforms 2 in a desired direction, but could also include more complex mechanisms (not shown) for mechanically moving platforms 2. In large scale operations, computer selection of movement routes may be desirable.

While a somewhat permanent structure is shown in the Figures, the system 1 is capable of being constructed as a portable structure. Struts 8, liner 33 and sidewall 34 may be constructed so as to allow the entire system 1 to be dismantled and moved, further enhancing the value of the system 1. Loading of platforms 2 into the basin 5 is accomplished using the same technique, whether on portable or permanent systems 1. Bearing means 17 are removed in at least one open space 42, allowing placement or removal of a platform to or from the space 42. To remove a platform 2, it is simple to slide the platform 2 off of adjacent bearing means 17 into the space 42. The procedure is reversed for addition of platforms 2.

As can be seen, a very versatile movable platform system 1 is provided which maximizes the utilization of a given piece of real estate. The system may be used for parking, container storage, a performance stage or many other uses. For example, platforms 2 may also be arranged in random patterns so as to create unique possibilities for indoor and outdoor exhibits or displays. Many other embodiments of the invention will occur to one skilled in the art, and are intended to be included within the scope and spirit of the following claims.

I claim:

1. A movable platform system, comprising:

a. a basin, defined by a bottom and a sidewall, said basin containing a liquid;

b. a plurality of support means, extending upward from said bottom, and including a first plurality of support means aligned in rows in one direction and a second plurality of support means aligned in rows perpendicular to said one direction;

c. a plurality of platforms each having a top surface and an underside, said platforms being floatable in said liquid, each said platform having a plurality of guide means attached to said underside, for guiding movement of said platforms in said basin, at least one said guide means being aligned perpendicular to another, wherein a plurality of said support means extend into said guide means; and d. a plurality of bearing means, attached to said support means, for supporting said underside of said platforms and allowing said platforms to move parallel to said bottom along some of said rows of said support means.

2. A movable platform system according to claim 1, wherein said guide means comprises a plurality of guide channels traversing said undersides of said platforms.

3. A movable platform system according to claim 2, wherein each said platform is provided with a plurality of said guide channels aligned in one direction and a plurality of said guide channels aligned perpendicular to said one direction.

4. A movable platform system according to claim 1, wherein each said support means comprises a vertically extending strut fixedly attached to said bottom of said basin.

5. A movable platform system according to claim 4, wherein said bearing means comprises a roller assembly.

6. A movable platform system according to claim 5, wherein said roller assembly comprises a roller containment structure, having upper and lower surfaces, fixedly attached to said strut and at least four spherical rollers rotatably contained within said roller containment structure such that said rollers extend from said upper and lower surfaces.

7. A movable platform system according to claim 2, wherein each said guide channel further comprises an upper bearing surface and a lower bearing surface, said lower bearing surface having a longitudinal slot therein.

8. A movable platform system according to claim 7, wherein each said support means comprises a vertically extending strut fixedly attached to said bottom of said basin and extending through one of said slots in said guide channels when one of said guide channels is over said strut.

9. A movable platform system according to claim 8, wherein said bearing means comprise a roller assembly.

10. A movable platform system according to claim 9, wherein said roller assembly comprises a roller containment structure, having upper and lower surfaces, fixedly attached to said strut and at least four spherical rollers rotatably contained within said roller containment structure such that said rollers extend from said upper and lower surfaces.

11. A movable platform system according to claim 1, wherein said bearing means comprises at least one friction reducing member, interposed between said support means and said guide means so as to reduce frictional forces inhibiting movement of said platform.

12. A movable platform system according to claim 11, wherein said friction reducing member comprises at least one low friction pad fixedly attached to said support means.

13. A movable platform system according to claim 8, wherein said bearing means comprises at least one friction reducing interposed between said strut and said guide means so as to reduce frictional forces inhibiting movement of said platform.

14. A movable platform system according to claim 13, wherein said friction reducing member comprises at least one low friction pad fixedly attached to said strut.

15. A movable platform system according to claim 1, wherein said support means are movable.

16. A movable platform system according to claim 15, wherein said support means may be removed from said basin.

17. A movable platform system according to claim 1, further comprising a means for moving said platforms from one location to another and which is selectively engageable with one or more of said platforms.

18. A movable platform system according to claim 6, wherein said rollers are spaced such that two of said rollers are located on either side of said slot when said roller structure is within one of said guide means.

19. A movable platform system according to claim 10, wherein said rollers are spaced such that two of said rollers are located on either side of said slot when said roller structure is within one of said guide channels.

* * * * *